United States Patent [19]

Hutchins

[11] Patent Number: 4,671,019

[45] Date of Patent: Jun. 9, 1987

[54] PORTABLE POWER OPERATED SANDER

[75] Inventor: Alma A. Hutchins, Pasadena, Calif.

[73] Assignee: Hutchins Manufacturing Company, Pasadena, Calif.

[21] Appl. No.: 830,574

[22] Filed: Feb. 18, 1986

[51] Int. Cl.[4] ..... B24B 23/00

[52] U.S. Cl. ..... 51/170 MT; 51/273

[58] Field of Search ..... 51/170 MT, 170 R, 170 TL, 51/273

[56] References Cited

U.S. PATENT DOCUMENTS

| | | | |
|---|---|---|---|
| 3,815,292 | 6/1974 | Hutchins | 51/170 MT |
| 3,824,689 | 7/1974 | Hutchins | 30/368 |
| 4,052,824 | 10/1977 | Hutchins | 51/170 MT |
| 4,355,487 | 10/1982 | Maier et al. | 51/170 MT |

OTHER PUBLICATIONS

Advertising Sheet Showing "Model 400", of National-Detroit, Inc.

Two Sheets of Literature of "Rodac Pneumatic Tools" Showing Model No. 2000 Parts List on p. 1 and Model Nos. 2010–2007, on p. 2, Literature Entitled Air Jitterbug Sander, Black and Decker Manufacturing Co.

Literature of National-Detroit, Inc. Showing Models 400, 150, 600, 300 and 300A.

Catalog of Hutchins Manufacturing Co., Catalog-H84.

Three Advertising Sheets Entitled "Double Action Sander", Double Action Sander (Dust Free Type), and Orbital Sander (Dust Free Type).

Advertising Sheet Having the Heading "Model 4500", and Model 4950 VA, Hutchins Manufacturing Co.

*Primary Examiner*—Roscoe V. Parker

*Attorney, Agent, or Firm*—William P. Green

[57] ABSTRACT

A portable abrading tool including a body which is adapted to be held by a user and which carries a motor, a head adapted to carry a sheet of sandpaper or other element for abrading a work surface, a drive connection for transmitting power from the motor to the head to power actuate the head relative to the body, preferably orbitally, and a flexible boot or other structure extending essentially about the drive connection and enclosing a space at the back of the head. The tool preferably contains suction passages which direct a vacuum induced flow of air and particles abraded from the work surface from a location near the work surface to a dust collection bag or discharge location without flow of the abraded particles through the mentioned enclosed space at the back of the head. The passages also direct a vacuum induced flow of air free of abraded particles from that enclosed space. The tubular flexible structure which extends about the enclosed space carries projections adapted to interfit with the coacting portions of the tool body and head to locate these elements in predetermined relative positions upon assembly of the tool.

30 Claims, 13 Drawing Figures

FIG. 10
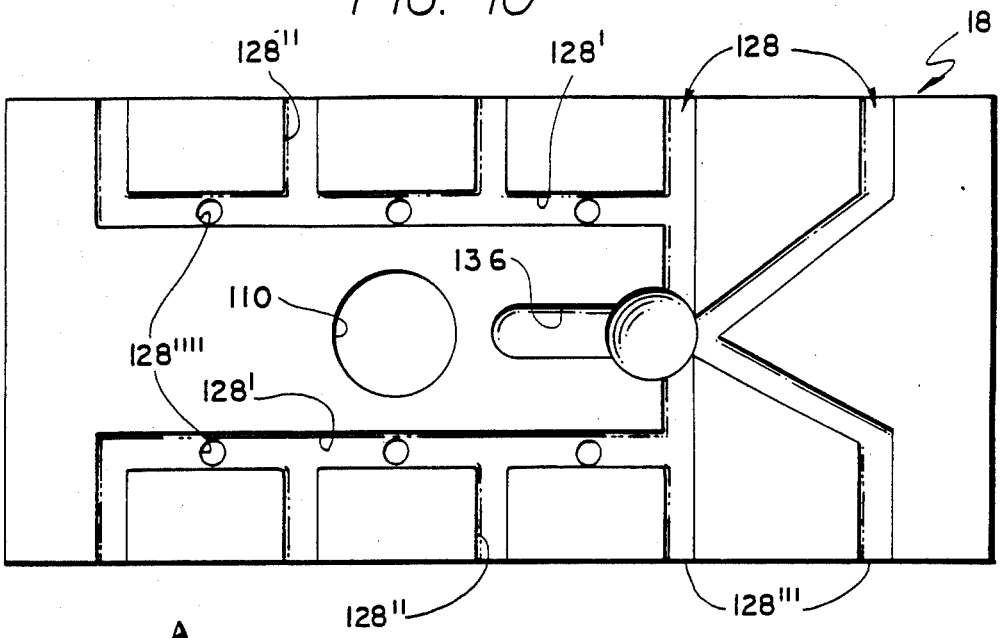
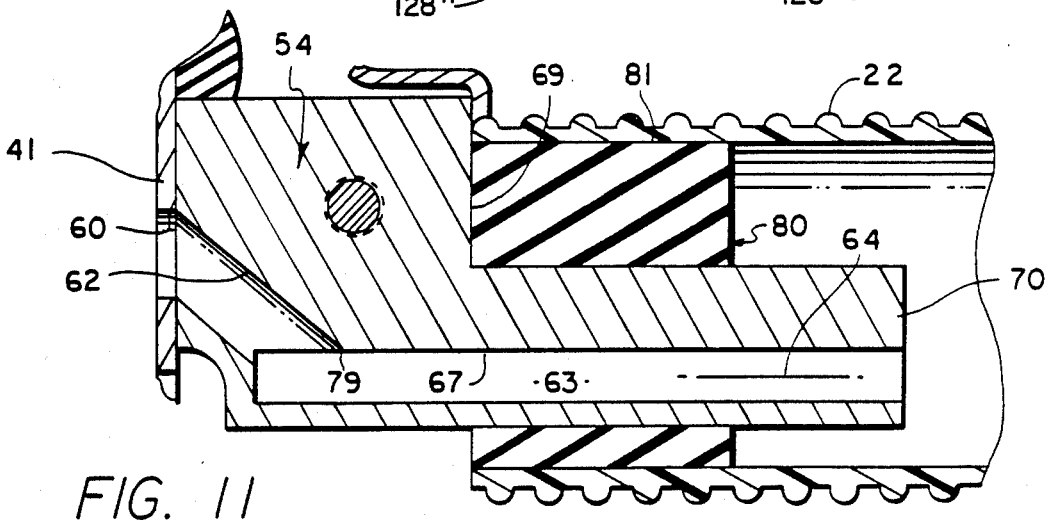
FIG. 11
FIG. 13
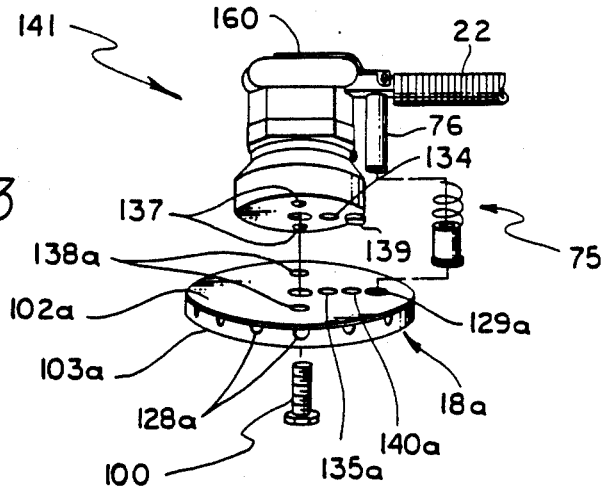
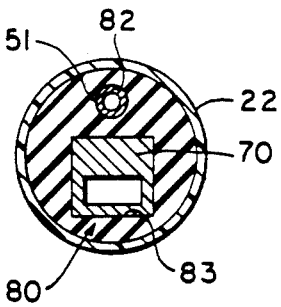
FIG. 12

PORTABLE POWER OPERATED SANDER

BACKGROUND OF THE INVENTION

This invention relates to improved portable power operated abrading or polishing tools.

The tools embodying the invention are of a general type including a body adapted to be held and manipulated by a user, a motor carried by the body, a head adapted to carry a sheet of sandpaper or other element for abrading a work surface, and a drive connection for transmitting power from the motor to the head to power actuate the head relative to the body, preferably orbitally, to abrade the work surface. Particles abraded from the work surface by the tool may be drawn by an aspirator or other suction device from a location near the work surface and through passages contained in the head of the tool for ultimate delivery to a dust collection bag or the like.

SUMMARY OF THE INVENTION

Certain features of the invention relate to the provision of a device of the above discussed type having an improved air flow pattern designed to withdraw abraded particles from near the work surface in a manner effectively avoiding contact of the particles with the drive connection between the motor and head of the device, to thereby prevent damage to the drive connection or related parts by the particles. When the motor is driven by air, the improved air flow pattern also serves a second function of positively withdrawing from the vicinity of the drive connection any leakage air which may escape from the motor in operation. Since it is customary for such air motors to be lubricated by the introduction of lubricant into compressed air fed to the device, withdrawal of any leakage air and entrained lubricant to a collection location is desirable in order to prevent contamination of the atmosphere near the tool with lubricant. In certain uses of an abrading tool, emission of even small amounts of contaminants by the tool may be disastrous, as for instance when the tool is being utilized to prepare a surface for painting and may prevent proper adherence of paint to the surface if oil or another substance is left on the surface.

To attain the above discussed advantages, a tool embodying the invention is preferably designed to provide an enclosed space located at the back of the power driven head of the tool and containing the drive connection extending between the motor and head, with air being withdrawn by suction from that enclosed space to positively remove any leakage air and contained lubricant for delivery to a discharge point. The suction system also withdraws a stream of air and abraded particles from a location near the work surface to a discharge location, but without flow of those particles through or into the discussed enclosed space at the back of the head. Thus, the air which is drawn from the enclosed space is free of abraded particles, and the drive connection and other elements within the enclosed space are effectively protected against contact with any of the abraded particles. The stream of air from the enclosed space may, after leaving that space, merge with the principal flow of air which carries the abraded particles, to flow therewith to an aspirator and then to a collection bag or chamber. Maximum simplicity and functional effectiveness can be achieved by merging the two streams within passages in a cushion portion of the orbitally movable head of the device, and then withdrawing the combined stream through a single sealed conduit structure extending from the head to the aspirator.

Additional features of the invention relate to a connector assembly by which an air inlet hose and a flexible discharge hose may be connected to the body of the tool. This connector includes a seal element extending about an inlet conduit and an exhaust conduit and adapted to engage an end of a discharge hose internally to form an effective seal between the conduits and the hose.

BRIEF DESCRIPTION OF THE DRAWINGS

The above and other features of the invention will be better understood from the following detailed description of the typical embodiments illustrated in the accompanying drawings, in which:

FIG. 10 is a horizontal section taken on line 10—10 of FIG. 1;

FIG. 11 is a fragmentary vertical section taken on line 11—11 of FIG. 4;

FIG. 12 is a reduced vertical section taken on line 12—12 of FIG. 3; and FIG. 13 is a perspective view showing a circular head which may be utilized with the tool.

DESCRIPTION OF THE PREFERRED EMBODIMENTS

Figure 1:
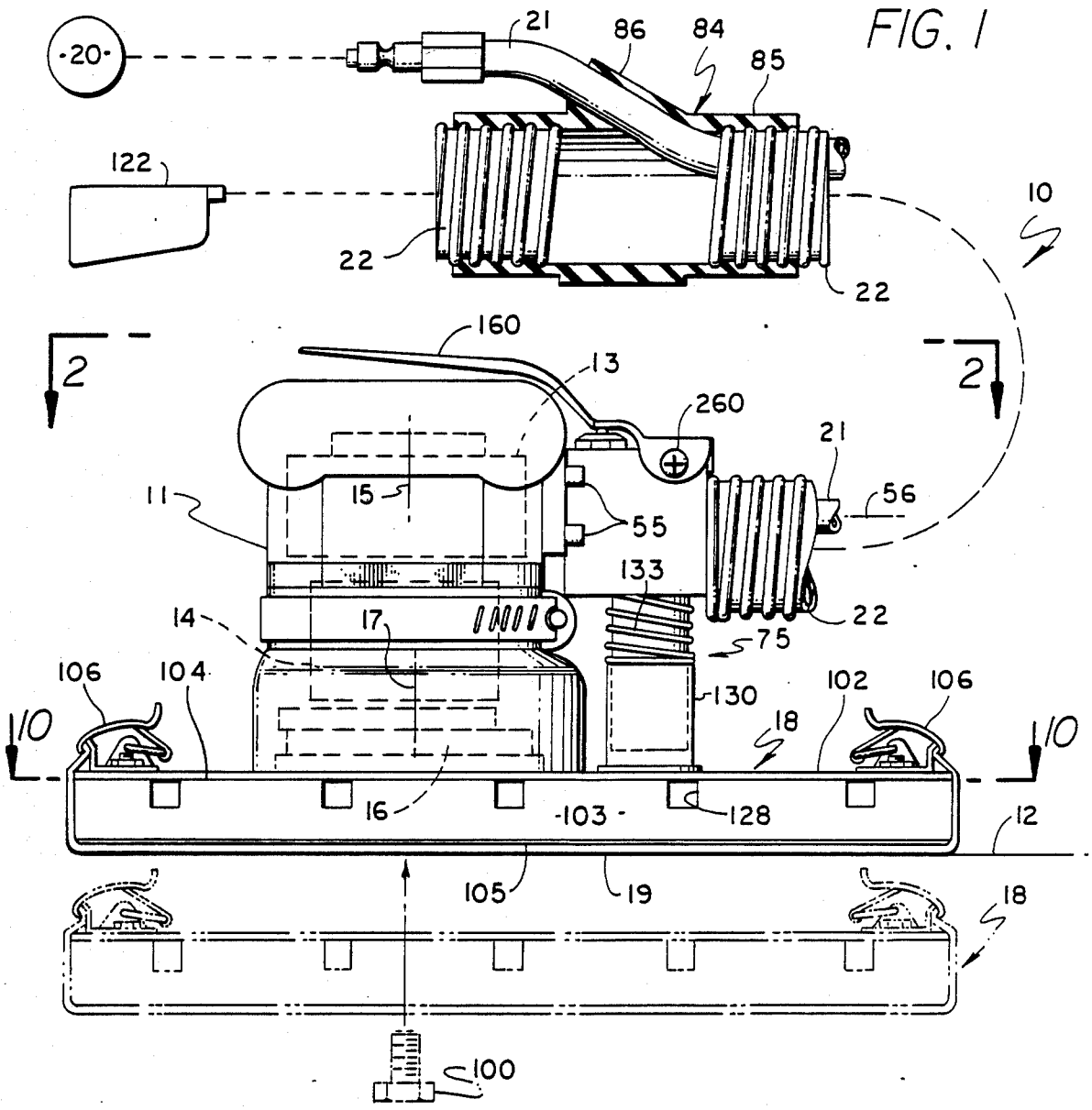
FIG. 1 is a side elevational view of an orbital sander constructed in accordance with the invention.

The tool 10 illustrated in the drawings is a power driven orbital sander having a body structure 11 shaped externally as a handle to be grasped by a user for holding the tool and moving it along a typically horizontal work surface 12 to sand or polish that surface. An air driven motor 13 contained within the body structure 11 drives a carrier part 14 rotatively about a vertical axis 15, with a part 16 being connected to carrier 14 for rotation relative thereto about a second axis 17, in a relation driving an abrading head or shoe 18 and a carried sheet of sandpaper 19 orbitally about axis 15 to sand the surface 12. Air is supplied to motor 13 from a source 20 of compressed air through a line 21 connecting into the rear of body structure 11. Exhaust air and particles abraded from the work surface are discharged by an aspirator 23 through a hose 22 leading to a dust collection bag or container 122.

The body structure or assembly 11 may include a rigid metal main body part 24 having an internal cylindrical surface 25 defining a recess within which motor 13 is received. Part 24 may have an outer surface 26 of square horizontal section, and have an annular horizontal flange 27 at its upper end for confining the motor against upward removal from the body. A square cushioning element 28 may be carried about body part 24 and extend across its upper side, and may be formed of an appropriate rubber, to function as a cushioned handle element by which the device is held in use. A rigid reinforcing element 29 is bonded to the undersurface of the top horizontal portion of handle cushion 28, and with the attached part 28 is secured to body 24 by four screws 30 (FIG. 6) extending downwardly through vertical aligned openings or passages in parts 24 and 29, with the heads of the screws engaging downwardly against part 29, and with the lower ends of the screws being connected threadedly to a retainer 31 which is tightenable upwardly against the motor to retain it in the recess 32 formed within the body structure.

Figure 3:
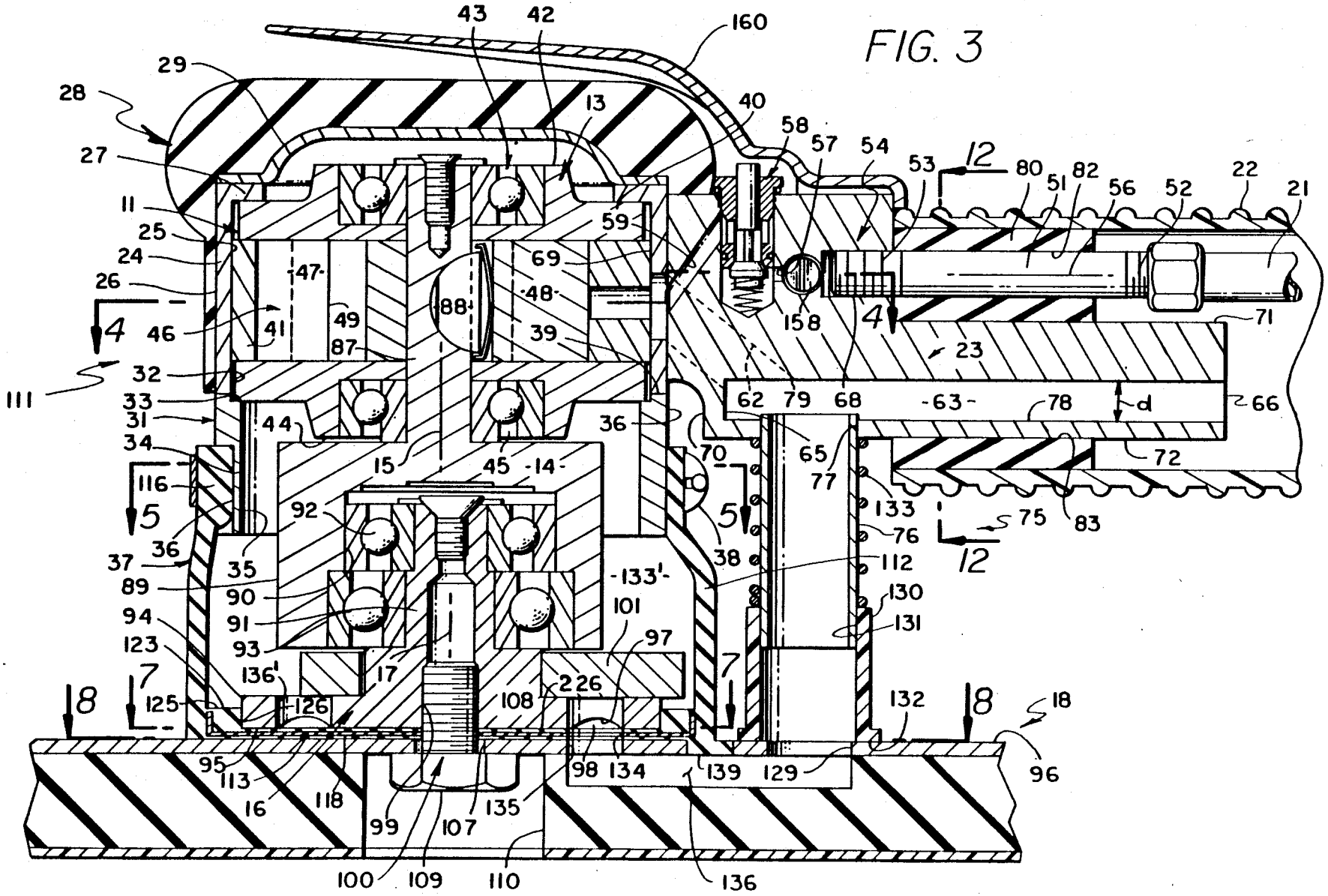
FIG. 3 is an enlarged vertical section taken on line 3—3 of FIG. 2.
Figure 6:
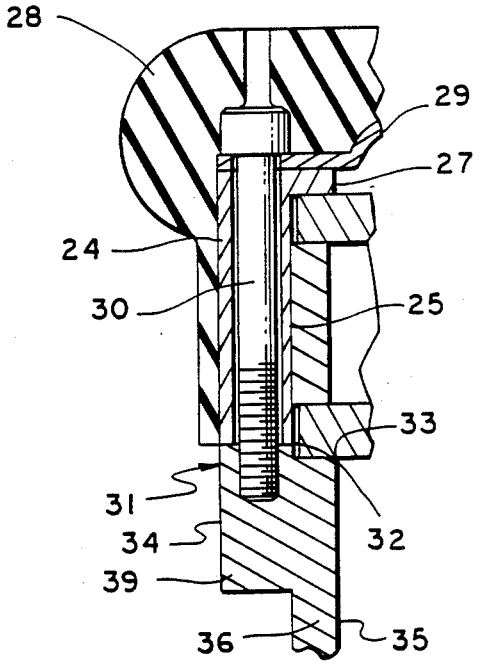
FIG. 6 is a fragmentary vertical section taken on line 6—6 of FIG. 2.
Figure 7:
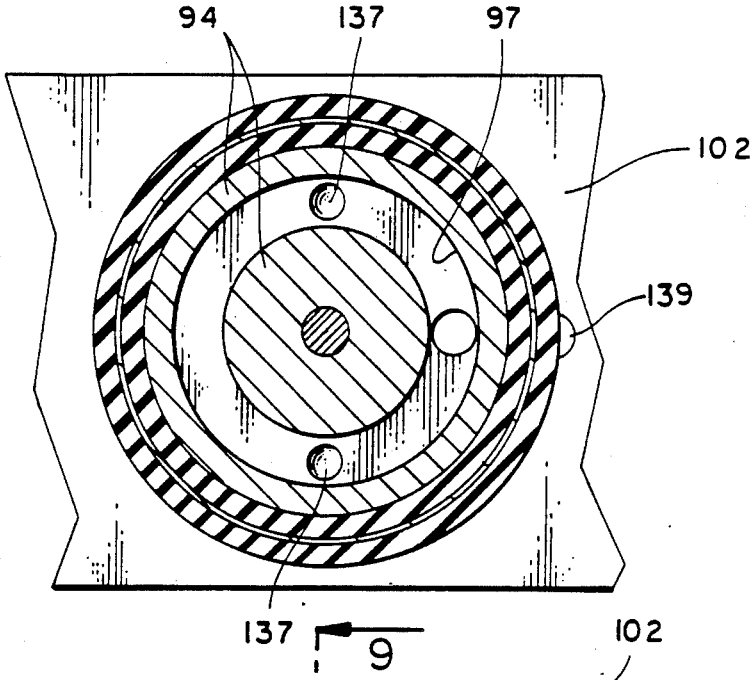
FIGS. 7 and 8 are fragmentary horizontal sections taken on lines 7—7 and 8—8 respectively of FIG. 3.

As seen in FIGS. 3 and 6, the radially inner portion of retainer 31 forms an upwardly facing annular horizontal shoulder surface 33 which projects inwardly beyond surface 25 to block downward withdrawal of the motor. The lower portion of retainer 31 forms a skirt 34 centered about axis 15 and having a cylindrical internal surface 35 and an essentially cylindrical external surface 36 about which the upper end of an essentially cup shaped boot member 37 is received and retained by an essentially annular clamp 38. Above cylindrical surface 36, retainer 31 has an upper flange portion 39 of essentially the same externally square congifuration as surface 26 of body part 24 for vertical alignment of the outer surface of flange 39 with that surface 26 of part 24.

Figure 4:
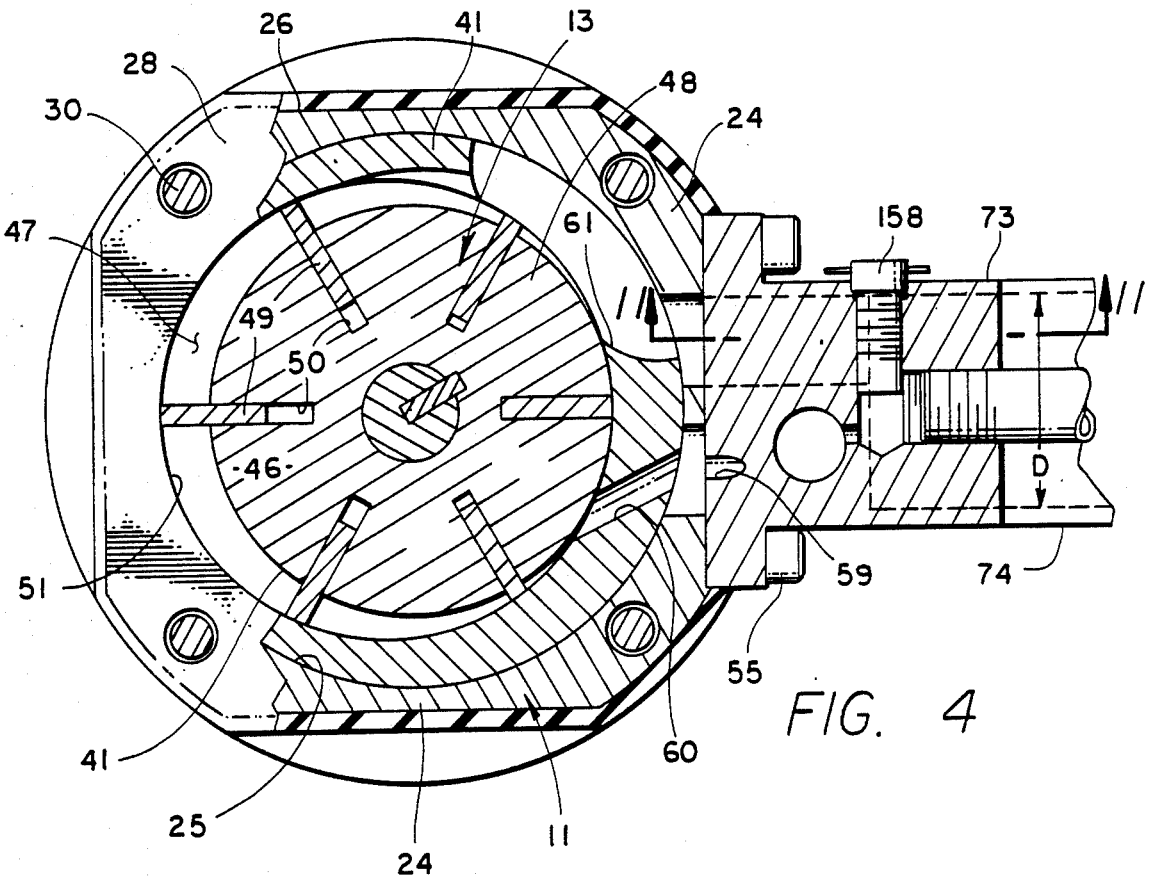
FIG. 4 is a horizontal section taken on line 4—4 of FIG. 3.

As seen in FIG. 3, the motor 13 may have a sectionally formed stator or housing 40 including a vertically extending side wall 41, a top wall 42 carrying a bearing 43 and a bottom wall 44 carrying a second bearing 45. These parts are externally circular and confined within recess 32 and clamped rigidly between retainer 31 and flange 27 by tightening of screws 30. A rotor assembly 46 is driven rotatively about axis 15 within chamber 47 in the stator, and includes a rotor body 48 and a series of radially extending vanes 49 received within radial grooves 50 in body 48 and movable radially inwardly and outwardly as the rotor turns (see FIG. 4). The outer extremities of the vanes contact an internal cylindrical surface 51 of side wall 41 of the stator, which surface is eccentric with respect to the rotary axis 15 of the motor. Compressed air is delivered to chamber 47 of the motor from inlet line 21 through a short externally cylindrical pipe 51 which is threadedly connected at one end 52 to flexible inlet air hose 21 within exhaust hose 22, and whose opposite end is threadedly connected at 53 into a block 54 secured by screws 55 to a side of main body part 24. In the FIG. 1 position of the tool, the axis 56 of pipe or tube 51 extends horizontally. From pipe 51, the inlet air flows through a passage 57 in block 54 to a manually actuable valve assembly 58 which is contained within a vertical recess in the block, and is actuable by depression of a lever 160 pivoted to the body at 260. The rate at which air can flow to the motor when valve 58 is open, and thus the speed of the motor, can be regulated by adjustment of a manually settable valve 158.

When valve assembly 58 is opened, air flows through a short passage 59 in the block and a communicating passage 60 in side wall 41 of the stator to enter chamber 47 at a location causing rotation of rotor 46. After turning the rotor, air discharges from chamber 47 through passages 61 in parts 24 and 41, and then enters a communicating passage 62 in block 54 forming part of the previously mentioned aspirator 23, with that passage extending downwardly at an inclination as illustrated in FIG. 11 and into a horizontally extending passage 63 of the aspirator formed in the block. Passage 63 extends along and is centered about a horizontal axis 64 which is parallel to and beneath the axis 56 of air inlet pipe 51. As seen in FIG. 12, the cross-section of passage 63 transversely of axis 64 is desirably rectangular, having a horizontal dimension D which is greater than its vertical dimension d. The passage may have the same rectangular cross-section across its entire length from its left end 65 as viewed in FIG. 3 to its right extremity 66. Passage 62 may open downwardly into the horizontal top wall 67 of rectangular passage 63, with the inclination of passage 62 acting to create a rapid rightward flow of air through passage 63. The portion 68 of block 54 into which air inlet pipe 51 is threadedly connected may have a vertical rear surface 69. Beneath that surface 69, the block has a portion 70 which projects rightwardly beyond the plane of surface 69 and which contains a portion of the rectangular passage 63. Externally, portion 70 of the block has a rectangular configuration defined by horizontal top and bottom surfaces 71 and 72 and parallel vertical side surfaces 73 and 74.

The rapid flow of air rightwardly in passage 63 of block 54 functions by aspirator action to induce a vacuum in a conduit assembly 75 which receives air and abraded particles from head 18. Assembly 75 includes a vertical internally and externally cylindrical rigid tube 76 whose upper end projects into a circular opening 77 formed in the bottom of block 54 and may be secured rigidly to the block in sealed relation by an appropriate adhesive. The upper end of the tube functions as part of the aspirator 23, and may project slightly above the horizontal bottom wall surface 78 defining the bottom of the rectangular passage 63 in the block, with the top of tube 76 being located beneath the lower end 79 of passage 62 in a manner causing the rightward flow of air from passage 62 across the upper end of tube 76 to create a vacuum in the upper end of the tube and induce a flow of air upwardly through the tube for admixture with the exhaust air from passage 62, to flow rightwardly through passage 63 and into hose 22.

The stream of air and abraded particles which discharges from the end 66 of the passage 63 in block 54 is allowed to expand at that location 66 into flexible hose 22 leading to collection chamber or bag 23. A seal is formed within the end of hose 22 and about the air inlet pipe 51 and the exhaust portion or projection 70 of block 54 by a seal element 80 which is formed of a resiliently deformable material such as rubber. Element 80 has an outer cylindrical surface 81 which is a tight fit within the end of hose 22 to frictionally retain the end of the hose and form an annular fluid tight seal therewith. Element 80 contains a cylindrical passage 82 within which air inlet pipe 51 is a tight fit, and also contains a rectangular passage 83 within which rectangular portion 70 of block 54 is a tight fit. Thus, the seal element 80 engages pipe 50 entirely about its periphery, and engages projection 70 of block 54 entirely about its periphery, in a manner forming seals preventing the flow of air past the seal element 80 along the exterior of pipe 51 and projection 70. Seal element 80 in this way blocks any flow of air into or out of the end of hose 22 except through pipe 51 and passage 63 in the lower rectangular portion of the block.

The flexible air inlet hose 21 may extend along the interior of outer hose 22 for a substantial distance of several feet from the location of tool 10, in order to facilitate handling of the tool and the single hose assembly in use. The air inlet hose 21 may extend to the exterior of hose 22 through a part 84, which may take the form of a short rubber tube 85 connected at its opposite ends to two sections of hose 22 and having a tubular portion 86 through which hose 21 may extend from the interior to the exterior of part 84 for connection separately to the compressed air source 20.

The carrier 14 which is driven by the rotor of motor 13 may have an upper relatively small diameter externally cylindrical shaft portion 87 connected to the rotor for rotation therewith by a key 88 received within opposed grooves in the rotor and shaft. The shaft 87 is journalled by bearings 43 and 45 for rotation about axis 15. Beneath the level of lower bearing 45, carrier part 14 has an enlarged portion 89 which is typically externally cylindrical about axis 15, and which contains a recess 90 centered about the second axis 17 which is parallel to but offset laterally from axis 15. The orbitally driven part 16 has an upper reduced diameter portion 91 which projects upwardly into recess 90 and is centered about axis 17 and journalled by two bearings 92 and 93 for rotation about axis 17 relative to carrier 14, so that as the carrier turns the part 16 is given an orbital motion. A lower enlarged diameter circular flange portion 94 of part 16 has a horizontal undersurface 95 disposed transversely of axis 17. Surface 95 is interrupted by an annular recess 97 formed in the underside of flange 94 and centered about axis 17 to define an annular passage 98 between the flange and surface 96 of head 18.

A threaded bore 99 extends upwardly into part 16 and is centered about vertical axis 17, for engagement with an externally threaded screw 100 which detachably secures head 18 to the rest of the device. A counterweight plate 101 may be located vertically between carrier 14 and flange 94 of part 16, and be secured rigidly to part 16 by appropriate fasteners, and may be externally noncircular about axis 15 to counterbalance the eccentrically mounted part 16, head 18, and other connected elements.

Figure 2:
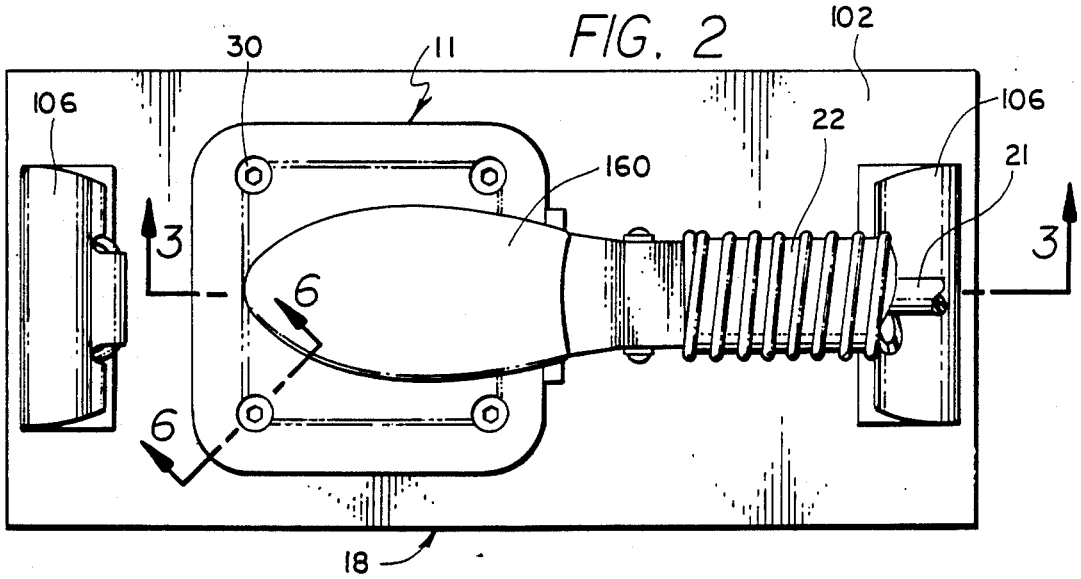
FIG. 2 is a plan view taken on line 2—2 of FIG. 1.

The head 18 of FIGS. 1 to 3 is rectangular in horizontal section, and includes an upper horizontally rectangular rigid flat metal backing plate 102 having a rectangular resiliently deformable cushion 103 at its underside typically formed of polyurethane foam, rubber, or the like, and bonded continuously to plate 102 at 104. The rectangular sheet of sandpaper 19 extends along the horizontal undersurface 105 of cushion 103 of the head, and then extends upwardly at opposite ends of the head for retention of its ends by two clips 106. Plate 102 contains an opening 107 (FIG. 3) which may be circular and of a diameter to receive the threaded shank 108 of screw 100, with the enlarged preferably hexagonal head 109 of the screw being tightenable upwardly against the plate about opening 107. An opening or passage 110 formed in pad 103 enables a wrench to be inserted upwardly into that passage and about head 109 of the screw to attach the head to the main drive portion of housing and motor assembly 111 of the tool, or remove it therefrom.

Figure 5:
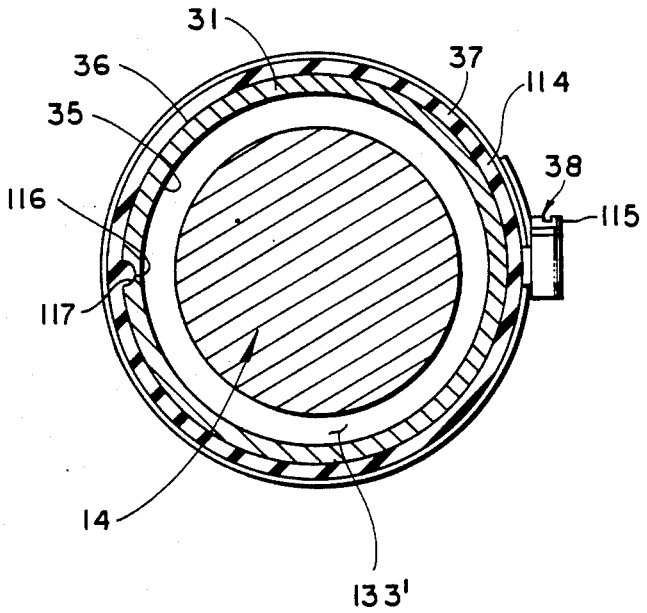
FIG. 5 is a reduced horizontal section taken on line 5—5 of FIG. 3.

The essentially cup shaped boot 37 connects the orbitally driven head 18 to the body structure of the tool in a manner retaining the head against rotation while at the same time permitting orbital movement thereof. The boot includes a flexible essentially tubular side wall member 112 connected at its upper end to retainer 31 and projecting downwardly toward head 18, and carrying a more rigid horizontally extending bottom wall 113 of the boot which is clamped vertically between top plate 102 of head 18 and flange 94 by tightening of screw 100, to thereby attach the lower end of the boot to the head and part 16 for orbital movement therewith. The tubular side wall member 112 of the boot extends about the orbital power drive assembly or connection between the motor and head 18 consisting of parts 14, 16, 92, 93, etc. Member 112 is formed of a resiliently flexible material, preferably in appropriate elastomeric material such as rubber, and is molded to a normally annular configuration, but is distorted slightly in use from that annular configuration so that the upper annular end 114 of member 112 is centered about axis 15 while the lower end of member 112 is centered about the orbitally moving axis 17. The upper end 114 is substantially cylindrical both internally and externally (FIG. 5), and is a close fit about the outer surface 36 of retainer 31. The clamp 38 is actuable by an adjusting screw 115 to tighten the clamp inwardly against retainer 31 or release the clamp to permit detachment of boot 37 from retainer 31 during assembly of the parts. The upper end 114 of member 112 and retainer 31 have portions interfitting in a keying relationship in a predetermined rotary setting of member 112 relative to the retainer, to locate boot 37 in that rotary setting and thereby assist in determining the orientation of head 18 relative to the handle portion of the tool. These interfitting elements preferably consist of a projection 116 formed by the upper portion 114 of member 112 and projecting radially inwardly into a correspondingly shaped recess or groove 117 formed in the outer surface of retainer 31. The projection 116 and recess 117 may extend vertically and have the arcuate horizontal cross-sectional configuration illustrated in FIG. 5 along the entire vertical extent of projection 116 and recess 117.

The bottom wall 113 of boot 37 is preferably more rigid than the readily flexible elastomeric side wall 112 of the boot, and is desirably given this rigidity by including in the bottom wall a circular plate 118 preferably formed of steel or other substantially rigid sheet metal. This plate 118 may be coated at its upper and lower sides by relatively thin layers 119 and 120 formed of the same deformable elastomeric material as side wall 112 of the boot. Plate 118 has a planar circular main portion 121 extending transversely of the two axes 15 and 17 and parallel to the upper surface 96 of plate 102 of head 18. At its periphery, plate 118 has an upwardly turned cylindrical side wall portion 122 centered on axis 17 and embedded within the material of the lower portion of rubber side wall 112 of boot 37. At the inner side of the lower portion of flexible side wall 112, the elastomeric material of that side wall may be shaped to form an annular portion 123 of the bottom wall at which the vertical thickness of the bottom wall is increased to define a circular recess 124 centered about axis 17 and adapted to closely receive and locate flange 94 of the orbital drive connection within the boot. More particularly, the annular portion 123 of elastomeric material may have an upper horizontal surface 125 and a vertical surface 126 extending cylindrically about axis 17 and forming the side wall of recess 124. The bottom of recess 124 is formed by the upper horizontal planar surface 226 of the top elastomeric layer 119 on plate 118 radially inwardly of the diameter of surface 126. At its center, the bottom wall 113 of boot 37 contains a circular opening 127 formed in and extending through plate 118 and both of its upper and lower elastomeric coating layers 119 and 120. This opening 127 is of a diameter corresponding to that of opening 107 in upper plate 102 of head 18, to closely receive the shank of screw 100 and thus locate the bottom wall of the boot relative to the head and part 16 when they are clamped together by the screw.

The cushioning pad 103 of sanding head 18 contains a number of suction passages 128 through which air and abraded particles are drawn by vacuum under the influence of the aspirator assembly 23 consisting of passages 62, 63, the upper end of tube 76, etc. Passages 128 may be formed in the upper surface of pad 103, adjacent top plate 102 of the head, with that plate being bonded continuously to the upper surface of pad 103 except at the locations of passages 128 to close the upper sides of the passages. The passages 128 may be arranged in the pattern illustrated in FIG. 10, to include a pair of principal passages 128' extending longitudinally of the rectangular head in spaced relation, with a series of branch passages 128'' extending laterally from each of the principal passages 128' to the edge of the pad and head, in order to pick up abraded particles from near the work surface at the open ends 128''' of the passages. There may also be branches 128'''' extending downwardly from the principal passages 128' through openings formed in the bottom of head 18 and through registering openings in the sandpaper sheet 19. Near one end of the sanding head 18, top plate 102 of that head contains an opening 129 communicating with passages 128' and also communicating with the lower end of conduit assembly 75 which leads to the aspirator.

In addition to the previously mentioned vertical tube 76 projecting downwardly from the block 54, the conduit assembly 75 includes a second tube 130 having an inner cylindrical surface 131 which is a very close fit about the external surface of tube 76 but is loose enough to permit upward and downward movement of tube 130 relative to tube 76. The lower end of tube 130 has a horizontal annular bottom surface 132 slidably engaging the upper horizontal planar surface 96 of top plate 102 of head 18, to form an annular seal at the lower end of tube 130 enclosing the flow of air and particles from head 18 into conduit assembly 75 and preventing leakage between the parts at that location. A coil spring 133 is received about tube 76 above tube 130, and bears upwardly against block 54 and downwardly against the upper end of tube 130 to yieldingly urge tube 130 downwardly into sealing contact with surface 96 of plate 102. This contact is maintained during and in spite of the orbital movement of head 18 when the tool is in operation. The internal diameter of tube 130 and of the opening formed at the lower end of that tube is sufficiently greater than the diameter of opening 129 in plate 102 to assure complete encirclement of opening 129 by the lower end of tube 130 in all relative positions of head 18 as it moves orbitally, to thus maintain the communication between opening 129 and tube 130 during that orbital movement. Tube 130 may have an enlarged diameter flange at its lower end as shown, to increase the radial dimension of the contacting and sealing surface 132. Tube 130 is preferably formed of a resinous plastic material capable of withstanding the relative sliding movement of the tube and engaging plate 102 without substantial wear on either the tube or plate. To attain this result, tube 130 may be formed of polyvinyl chloride or ABS.

In addition to the principal flow of air and abraded particles from near the work surface, the aspirator also creates a secondary flow of air from the enclosed space 133' formed within boot 37 and encircled by the flexible side wall 112 of that boot. The air is drawn from this space 133' in a manner preventing the flow of any of the abraded particles into that space and thus protecting the bearings 92 and 93 of the orbital drive connection and bearing 45 at the bottom of the motor against damage which might otherwise be caused by contact with the particles. Also, the withdrawal of air from the enclosed space 133' within the boot assures against the development of an unwanted pressure condition within the boot resulting from the inevitable slight leakage of air which must occur from the motor downwardly past bearing 45 and into space 133'. As air leaks downwardly from the motor into space 133', it is continually withdrawn from that space by the aspirator. In addition to preventing the development of a pressure condition in space 133', this withdrawal of the air from the space acts to assure removal of lubricant contained in that air and to prevent escape of any such lubricant into the surrounding atmosphere. As will be understood, lubricant is normally entrained in the air supplied to a motor for a tool of the present type, in order to continually lubricate the motor, vanes, bearings, etc.

The discussed removal of air from space 133' is attained by producing a vacuum induced flow of air downwardly from space 133' through an opening 134 in bottom wall 113 of boot 37 and then downwardly through a registering opening 135 in top plate 102 of head 18, and then into a communicating passage 136 in pad 103 leading to opening 129 in plate 102 at the lower end of suction conduit assembly 75. The previously mentioned annular groove 97 in the bottom of part 16 is formed at a diameter to have a portion of this groove received directly above opening 134 in the boot, so that air from space 133' may enter opening 134 from whatever portion of groove 97 happens to be directly above opening 134. Air from chamber 133' enters groove 97 through one or more openings 136' extending vertically through flange 94 of part 16 at a location or locations maintaining continuous communication between space 133' and the groove.

Figure 8:
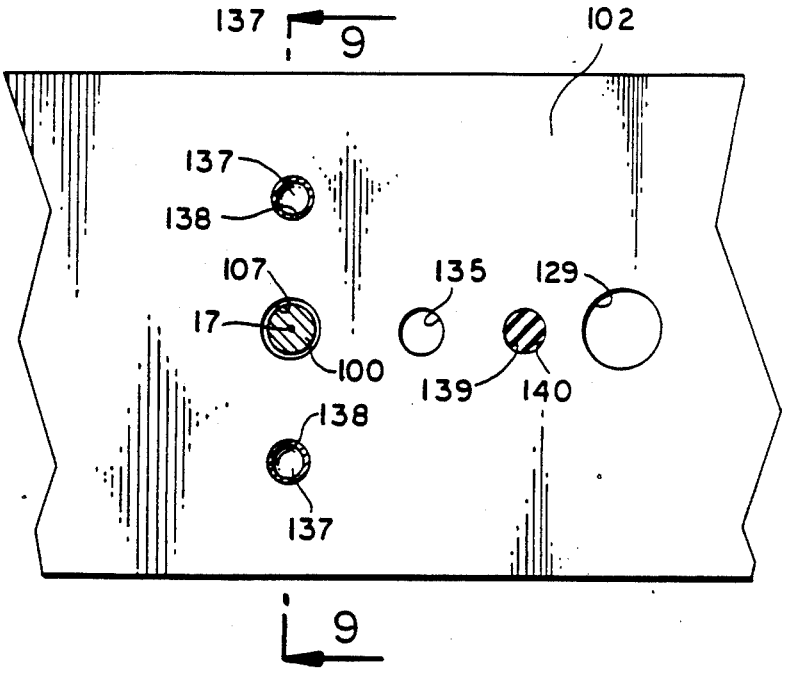
Figure 9:
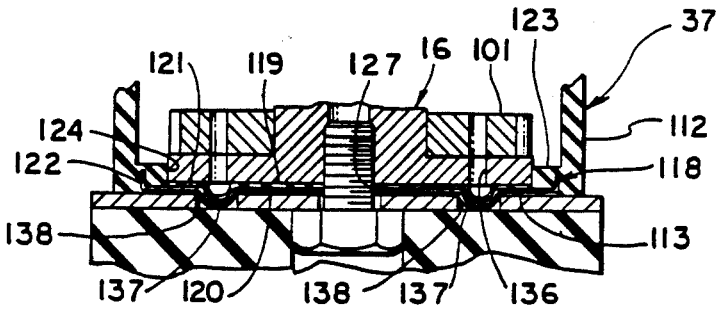
FIG. 9 is a fragmentary vertical section taken on line 9—9 of FIG. 8.

To orient head 18 rotatively relative to flange 94 of part 16 in a desired position during assembly of the tool, for the purpose of aligning openings 134 and 135 and aligning conduit assembly 75 with opening 129, and also to align the longitudinal axis of the head with the handle of the tool, the essentially rigid plate 118 of bottom wall 113 of boot 37 is locally deformed downwardly at two diametrically opposite locations to form two locating projections or dimples 137 (FIG. 9) which are receivable within two openings 138 formed in top plate 102 of the orbitally movable head at diametrically opposite locations with respect to axis 17 (FIG. 8). In addition, the elastomeric material which forms side wall 112 of the boot may be shaped to form a third projection 139 at an edge of the boot, (FIGS. 3 and 8), with this projection desirably being cylindrical about a vertical axis and receivable within an opening 140 in plate 102. Projection 139 and opening 140 may be located circularly midway between the two diametrically opposed locating projections 137, and thus be offset 90° (about axis 117) from those projections. The locating openings 138 and 140 in plate 102 are preferably not positioned to communicate with any of the air suction passages 128 etc. in the head.

In FIG. 13, the motor and handle assembly of the FIG. 1 tool is designated generally by the number 141, after removal of head 18 from that assembly by detachment of screw 100. The purpose of FIG. 13 is to show the manner in which a circular head 18*a* may be utilized with the main drive assembly 141 in lieu of rectangular head 18 if desired. Head 18*a* includes a rigid top plate 102*a* corresponding to plate 102 of the first form of the invention but of circular rather than rectangular configuration, and carrying a circular foam pad 103*a* containing passages 128*a* through which air is drawn by vacuum to an opening 129*a* in plate 102*a* corresponding to opening 129 of the first form of the invention. The locating projections 137 and 139 on the bottom of assembly 141 are received within three openings 138*a*, 138*a* and 140*a* in plate 102*a* corresponding to openings 138, 138 and 140 of plate 102, to orient the circular head rotatively relative to the drive assembly 141 in a manner placing opening 134 at the bottom of the boot in communication with an opening 135*a* formed in plate 102*a* and corresponding to opening 135 of the first form of the invention. Thus, air is drawn downwardly from within the boot of assembly 141 through openings 134*a* and 135*a* into a passage in head 18*a* which ultimately leads the air through opening 129*a* into suction conduit assembly 75. The rotary orientation of the parts by the interfitting projections and openings also serves to locate this conduit assembly 75 directly above and in alignment with opening 129*a*.

In using the tool of the present invention, any one of several different heads including head 18 of FIGS. 1 to 12 or the head 18*a* of FIG. 13 may be attached to the main handle and motor assembly 141 by screw 100. The head is merely turned to a proper rotary position in which the projections at the bottom of wall 113 of the boot are received within the corresponding openings in the top plate of the head, and screw 100 is then tightened upwardly to secure the head to part 16 while clamping the bottom wall 113 of the boot tightly between these parts. In this way, the entire assembly is effected by tightening of a single fastener 100. The user then holds the tool by its upper handle 28, and depresses lever 160 to open the air valve and admit air to the motor. This commences rotation of the motor and orbital movement of head 18 or 18*a*, with continual slight distortion of the rubber side wall 112 of boot 37 as the head moves orbitally relative to the body of the device. The air exhausted from the motor, in blowing across the upper end of tube 76, creates a vacuum in the upper end of that tube acting to produce a flow of air and abraded particles from near the work surface through the passages in head 18 or 18*a*, and simultaneously to produce a flow of air and any contained lubricant, free of particles, from the enclosed space 133' within the boot and about the orbital drive connection between the motor and head. The atmosphere surrounding the tool is thus freed of abrasive particles, and in addition cannot be contaminated by lubricant leaking from the motor into enclosed space 133', since that lubricant is drawn with the air in that space to the aspirator for discharge with the abraded particles through hose 22 to the collection bag or other collection equipement represented at 23.

While certain specific embodiments of the present invention have been disclosed as typical, the invention is of course not limited to these particular forms, but rather is applicable broadly to all such variations as fall within the scope of the appended claims.

I claim:

1. A portable tool comprising:

a body to be held by a user;

a motor carried by said body;

a head adapted to carry an element for abrading a work surface;

a drive connection for transmitting power from said motor to said head to power actuate the head relative to the body and thereby abrade said work surface;

a structure extending essentially about said drive connection and enclosing a space at the back of the head; and suction means for producing a vacuum induced flow of air, and particles abraded from the work surface, from a location near the work surface to a discharge location without flow of abraded particles through said space enclosed by said structure, and for also producing a vacuum induced flow of air, free of abraded particles, from said enclosed space to a discharge location.

2. A portable tool as recited in claim 1, in which said suction means include at least one passage formed in said head and having an end opening near the work surface to receive particles abraded therefrom.

3. A portable tool as recited in claim 1, in which said suction means include a passage formed in said head and communicating with said enclosed space in a relation directing a vacuum induced flow of air from said enclosed space through said passage in the head for delivery to a discharge location.

4. A portable tool as recited in claim 1, in which said suction means include passages formed to direct said vacuum induced flow of air which is withdrawn from said enclosed space free of abraded particles into admixture, at a location outside of said enclosed space, with said vacuum induced flow of air and abraded particles from near the work surface for flow therewith to a discharge location.

5. A portable tool as recited in claim 1, in which said motor is a rotary air motor from which there may be slight air leakage into said enclosed space.

6. A portable tool as recited in claim 1, in which said motor is fluid driven, and said suction means include an aspirator which receives fluid discharged from said motor and is energized thereby to induce said flow of air and particles from near the work surface and said flow of air free of abraded particles from said enclosed space.

7. A portable tool as recited in claim 1, in which said drive connection is an orbital drive acting to power actuate said head orbitally relative to said body.

8. A portable tool as recited in claim 1, in which said drive connection is an orbital drive acting to power actuate said head orbitally relative to said body, said structure including a generally tubular member of flexible material defining said enclosed space and disposed about said orbital drive connection and connected to said body and said head in a relation retaining the head against rotation while permitting orbital movement thereof.

9. A portable tool as recited in claim 8, including a wall structure carried by an end of said flexible generally tubular member and extending essentially transversely across said end and adapted to be clamped between said head and said drive connection, said suction means including an opening extending through said wall structure and through which air free of abraded particles is withdrawn from said enclosed space within said generally tubular member, and including at least one passage formed in said head for directing said vacuum induced flow of air and particles from near the work surface to a discharge location, and into which air free of said particles flows from said opening for admixture with said flow of air and abraded particles.

10. A portable tool comprising:

a body structure adapted to be held by a user to manipulate the tool;

a rotary air motor carried by said body structure;

a carrier driven rotatably about a first axis by said motor;

a part which is connected to said carrier for rotation relative thereto about a second axis offset from said first axis to drive said part orbitally as the carrier turns;

a head to be driven orbitally by said part and adapted to carry an element for abrading a work piece;

a generally tubular member of flexible material extending essentially about said carrier and said part and defining an enclosed space containing said carrier and said part;

said generally tubular member being connected at opposite ends to said body structure and said head for retaining the head against rotation while permitting orbital movement thereof;

an aspirator carried by said body structure and which receives air discharged from said motor and is energized thereby to draw a vacuum induced flow of air and abraded particles from a location near the work surface through the aspirator for delivery to a discharge location;

said head including a cushion containing passage means for receiving air and abraded particles from near the work surface and directing said air and particles to the aspirator for discharge therefrom without flow of any of the particles into or through said enclosed space within said generally tubular flexible member;

there being additional passage means for delivering a flow of air induced by said aspirator and free of abraded particles from said enclosed space within said generally tubular member of flexible material.

11. A portable tool as recited in claim 10, in which said additional passage means are formed to deliver said flow of air free of particles from said enclosed space within said generally tubular member into the interior of said orbitally movable head for flow therethrough to the aspirator.

12. A portable tool as recited in claim 11, including a conduit structure for delivering air and abraded particles from said head to said aspirator, said conduit structure including a first tube attached to the aspirator, a second tube communicating with said first tube and movable axially relative thereto and slidably engaging said head for reception of air and abraded particles therefrom, and a spring urging said second tube axially relative to said first tube and against said head.

13. A portable tool as recited in claim 10, including a fastener adapted to be connected threadedly to said part and acting to attach said head to said part for orbital movement therewith, there being a plate carried by an end of said flexible generally tubular member and extending essentially transversely across said end thereof and projecting inwardly essentially toward said second axis at a location to be confined axially between said head and said part upon tightening of said fastener, said additional passage means including an opening formed through said plate for delivering a flow of air free of abraded particles from said enclosed space through said opening and into the interior of said head for admixture therein with a flow of air and abraded particles received from near the work surface.

14. A portable tool comprising:

a body to be held by a user;

a motor carried by said body;

a head power actuated by said motor relative to said body and adapted to carry an element for abrading a work surface;

an aspirator carried by the body and adapted to receive air discharged from the motor and which is energized by said discharged air to produce a vacuum induced flow of air and abraded particles from near the work surface to the aspirator for discharge therefrom;

said head containing passage means through which said air and abraded particles flow; and a conduit structure for delivering said air and particles from the head to said aspirator;

said conduit structure including two aligned tubes communicating with said head and said aspirator respectively and a first of which is movable axially relative to the second tube and slidably engages a coacting part about an opening therein, and a spring disposed about one of said tubes and yieldingly urging said first tube axially relative to the second and against said part about said opening.

15. A portable tool comprising:

a body to be held by a user;

a motor carried by said body;

a head power actuated by said motor relative to said body and adapted to carry an element for abrading a work surface;

an aspirator carried by the body and adapted to receive air discharged from the motor and which is energized by said discharged air to produce a vacuum induced flow of air and abraded particles from near the work surface to the aspirator for discharge therefrom;

said head containing passage means through which said air and abraded particles flow; and an extensible conduit structure for conducting air and abraded particles from said head to said aspirator;

said conduit structure including a first tube attached to said aspirator and projecting therefrom toward said head, a second tube aligned with said first tube and communicating therewith and movable axially relative thereto and having an end slidably engaging said head about an opening therein to receive air and abraded particles therefrom, and a spring disposed about one of said tubes and yieldingly urging said second tube axially relative to said first tube and against said part containing said opening.

16. A portable tool comprising:

a body to be held by a user;

an air operated motor carried by said body;

a head power actuated by said motor relative to said body and adapted to carry an element for abrading or polishing a work surface;

an air inlet conduit connected to said body and through which air under pressure flows to said motor to drive it;

an air outlet conduit carried by said body and projecting therefrom in essentially the same direction as said air inlet conduit but offset therefrom, and through which air from the motor is discharged;

a flexible hose which has a portion near an end thereof disposed about portions of both of said conduits and which is adapted to receive air from said outlet conduit and deliver it to a discharge location; and a seal member of deformable material which is received about said portions of both of said conduits and is received within said portion of said flexible hose, and which engages the outside of said conduits and the inside of said hose in a relation closing the end of the hose about the conduits.

17. A portable tool as recited in claim 16, including an aspirator structure carried by said body and from which said conduits project, said aspirator structure being adapted to receive air discharged from said motor and induce a flow of air and abraded particles from near the work surface through said air outlet conduit and past said seal member into said hose.

18. A portable tool as recited in claim 16, in which said seal member has an essentially cylindrical external surface engaging the interior of said hose.

19. A portable tool as recited in claim 16, in which said air inlet conduit is essentially cylindrical and extends through an essentially cylindrical passage in said seal member, and said air outlet conduit is of essentially rectangular crosssection and extends through a similarly rectangular passage in said seal member.

20. A portable tool as recited in claim 16, in which said body includes a first body structure containing said motor and a block secured to a side of said first body structure, said air inlet conduit including a section of pipe connected threadedly into said block for delivering air to the motor, said air outlet conduit being formed integrally with said block and projecting therefrom and being of essentially rectangular cross-section, said block containing a passage receiving discharged air from said motor and delivering it into said rectangular cross-section air outlet conduit, there being a tube projecting downwardly from said block and adapted to receive a flow of air and abraded particles from said head, said passage in said block being formed to direct discharge air from the motor past the upper end of said tube in a relation acting by aspirator action to induce said flow of air and particles upwardly through said tube and then through said air oulet conduit into said hose.

21. A portable tool comprising:

a body structure adapted to be held by a user to manipulate the tool;

a motor carried by said body structure;

a head adapted to carry an element for abrading a work surface;

an orbital drive connection for transmitting power from said motor to said head and acting to drive the head orbitally relative to said body structure about an axis to thereby abrade said work surface;

fastener means for securing said head to said orbital drive connection;

a generally tubular member of flexible material for retaining said head against rotation while permitting orbital movement thereof and having a first end connected to said body structure;

a wall carried by said generally tubular member and extending across a second end thereof generally transversely of said axis and adjacent said head; and interfitting locating means on said wall and said head engageable to retain said head against rotation relative to said wall and said tubular member.

22. A portable tool as recited in claim 21, in which said interfitting means include at least one projection formed on said wall and extending downwardly into a recess in said head in locating relation.

23. A portable tool as recited in claim 21, in which said wall includes a plate received in close proximity to an upper surface of said head and having at least one projection extending downwardly into a recess in said head in locating relation.

24. A portable tool as recited in claim 21, in which said head contains passages through which air and abraded particles flow by vacuum toward a discharge location, said wall and said head containing aligned openings through which air from within said generally tubular member of flexible material flows downwardly into the interior of the head for discharge therefrom with said particles.

25. A portable tool as recited in claim 21, in which said wall includes a plate which is more rigid than said generally tubular member, said interfitting means including a projection formed of flexible material and extending downwardly from said generally tubular member and beneath said wall and into a recess in said head in locating relation.

26. A portable tool as recited in claim 21, in which said wall includes a plate formed of a material more rigid than said generally tubular member, and which is coated by said flexible material at its underside, said interfitting means including projections formed by said plate and extending downwardly into recesses in said head in locating relation, said interfitting means including also a projection formed of said flexible material and extending downwardly into an additional recess in said head.

27. A portable tool as recited in claim 26, in which said wall and said head contain aligned apertures through which air from within said generally tubular member can flow downwardly into the interior of said head.

28. A portable tool as recited in claim 21, including additional interfitting means carried by said body structure and said first end of said generally tubular member and engageable in a relation locating said generally tubular member against rotation relative to said body structure from a predetermined relative position.

29. A portable tool as recited in claim 21, in which said body structure has an external cylindrical surface about which an internally cylindrical portion of said generally tubular member is received at said first end of said genernally tubular member, said first end of said generally tubular member having a projection extending into a recess in said body structure at the location of said cylindrical surface to retain said generally tubular member against rotation relative to the body structure from a predetermined setting.

30. A portable abrading tool comprising:

a body to be held by a user;

a motor carried by said body;

a head adapted to carry an element for abrading a work surface;

an orbital drive connection for transmitting power from said motor to said head to actuate the head orbitally relative to the body and relative to said work surface;

a generally tubular member of flexible material for retaining said head against rotation while permitting orbital movement thereof and having a first end connected to said body structure and a second end connected to said head;

said first end of said generally tubular member having an essentially circular portion extending about an essentially circular portion of said body structure;

one of said essentially circular portions having a projection extending radially into a recess in the other of said essentially circular portions to locate said generally tubular member of flexible material against rotation from a predetermined setting relative to said body.

* * * * *